US010767874B2

(12) United States Patent
Yamasari

(10) Patent No.: US 10,767,874 B2
(45) Date of Patent: Sep. 8, 2020

(54) CEILING-EMBEDDED AIR CONDITIONER

(71) Applicant: FUJITSU GENERAL LIMITED, Kawasaki-shi, Kanagawa-ken (JP)

(72) Inventor: Kazuaki Yamasari, Kawasaki (JP)

(73) Assignee: FUJITSU GENERAL LIMITED, Kawasaki-Shi, Kanagawa-Ken (JP)

( * ) Notice: Subject to any disclaimer, the term of this patent is extended or adjusted under 35 U.S.C. 154(b) by 788 days.

(21) Appl. No.: 14/879,431

(22) Filed: Oct. 9, 2015

(65) Prior Publication Data

US 2016/0102871 A1 Apr. 14, 2016

(30) Foreign Application Priority Data

Oct. 10, 2014 (JP) ..... 2014-209324

(51) Int. Cl.

| | |
|---|---|
| ***F24F 1/0011*** | (2019.01) |
| ***F24F 1/0007*** | (2019.01) |
| ***F24F 1/0047*** | (2019.01) |
| ***F04D 29/16*** | (2006.01) |
| ***F24F 1/0022*** | (2019.01) |
| ***F24F 1/0025*** | (2019.01) |
| ***F24F 1/0059*** | (2019.01) |
| ***F24F 13/20*** | (2006.01) |

(52) U.S. Cl.

CPC ..... *F24F 1/0011* (2013.01); *F04D 29/162* (2013.01); *F24F 1/0007* (2013.01); *F24F 1/0022* (2013.01); *F24F 1/0025* (2013.01); *F24F 1/0047* (2019.02); *F24F 1/0059* (2013.01); *F24F 2013/205* (2013.01)

(58) Field of Classification Search

CPC .. F24F 1/00; F24F 1/003; F24F 1/0007; F24F 1/0011; F24F 1/0014; F24F 1/0022; F24F 1/0025; F24F 1/0059; F24F 2001/0037; F24F 2001/0074; F24F 2001/0081; F04D 29/162

USPC ..... 165/122, 125, 126

See application file for complete search history.

(56) References Cited

U.S. PATENT DOCUMENTS 6,470,699 B1 * 10/2002 Okuda ..... F24F 1/0007 62/259.2
6,481,237 B2 * 11/2002 Kim ..... F24F 1/0011 62/279

(Continued)

FOREIGN PATENT DOCUMENTS

JP 2007-100548 A 4/2007
JP 2012-002165 A 1/2012

*Primary Examiner* — Claire E Rojohn, III
*Assistant Examiner* — Gustavo Hincapie Serna
(74) *Attorney, Agent, or Firm* — Manabu Kanesaka

(57) ABSTRACT

A ceiling-embedded air conditioner includes: a ceiling-embedded casing body that has an air suction path at the center of a lower surface and has an air blowoff path around the air suction path; a turbo fan that is disposed inside the casing body; a heat exchanger that is disposed inside the casing body on an outer peripheral side of the turbo fan; a bell-mouth that guides air sucked from the air suction path toward the inside of the turbo fan; and a rectifier that is provided on a back surface side of the bell-mouth at the air suction path side opposite to an air suction surface of the bell-mouth, the rectifier suppressing swirling airflows generated by part of air blown from the turbo fan swirling along the back surface of the bell-mouth in the same direction as a rotation direction of the turbo fan.

7 Claims, 6 Drawing Sheets

(56) References Cited

U.S. PATENT DOCUMENTS

| | | | | |
|---|---|---|---|---|
| 7,066,712 | B2 * | 6/2006 | Kim | F04D 17/165<br>415/176 |
| 10,473,356 | B2 * | 11/2019 | Kato | F24F 1/0059 |
| 2006/0010901 | A1 * | 1/2006 | Iwata | F24F 1/0007<br>62/426 |
| 2008/0035317 | A1 * | 2/2008 | Choi | F24F 1/0007<br>165/122 |
| 2009/0007580 | A1 * | 1/2009 | Sakashita | F24F 13/222<br>62/259.1 |
| 2009/0255654 | A1 | 10/2009 | Zheng et al. | |
| 2012/0195752 | A1 * | 8/2012 | Lopez Partida | F01D 25/24<br>415/213.1 |
| 2012/0230816 | A1 * | 9/2012 | Boufflert | F04D 29/426<br>415/203 |
| 2012/0308370 | A1 * | 12/2012 | Nagae | F04D 29/162<br>415/203 |
| 2014/0231051 | A1 * | 8/2014 | Cho | F24F 1/0007<br>165/121 |
| 2015/0253032 | A1 * | 9/2015 | Kono | F24F 13/08<br>165/177 |
| 2016/0076789 | A1 * | 3/2016 | Kojima | F24F 1/0014<br>454/349 |
| 2017/0299201 | A1 * | 10/2017 | Obara | F24F 1/0047 |

* cited by examiner

CEILING-EMBEDDED AIR CONDITIONER

CROSS-REFERENCE TO RELATED APPLICATION

This application claims priority from Japanese Patent Application No. 2014-209324 filed with the Japan Patent Office on Oct. 10, 2014, the entire content of which is hereby incorporated by reference.

BACKGROUND

1. Technical Field

The present disclosure relates to a ceiling-embedded air conditioner. More specifically, the present disclosure relates to a ceiling-embedded air conditioner that suppresses swirling airflows generated on the back surface of a bell-mouth by rotation of a turbo fan.

2. Description of the Related Art

The ceiling-embedded air conditioner has a casing body including a heat exchanger and a blower (turbo fan). The casing body is embedded in a space formed between a ceiling slab and a ceiling panel. A flat square decorative panel is attached to the lower surface of the casing body. The decorative panel has an air inlet and an air outlet.

In the configuration described in JP-A-2012-2165, the casing body is a cuboid in shape. The turbo fan is disposed at the center of the casing body. The heat exchanger is disposed to surround the outer periphery of the turbo fan. A bell-mouth is provided between the air inlet and the turbo fan. The bell-mouth guides the air, which is taken into the casing body from the air inlet, to the inside of the turbo fan.

The turbo fan has a main plate, a shroud, and a plurality of blades. The main plate has a hub, to which a rotation shaft is fixed, at the center. The shroud is disposed to be opposite to the direction of axis of the rotation shaft relative to the main plate. The plurality of blades is disposed between the main plate and the shroud. The shroud has an opening at the center through which the bell-mouth is partially inserted into the turbo fan.

The bell-mouth has a base portion and a suction guide portion. The base portion is formed in a square shape corresponding to the shape of the air inlet. The suction guide portion is formed in a trumpet shape from the center of the base portion toward the inside of the turbo fan. As the turbo fan is driven, the air is sucked from the air inlet through the bell-mouth to the inside of the turbo fan (refer to JP-A-2012-2165, FIG. 2).

The air blown from the turbo fan is directed to the surrounding heat exchanger, and is heat-exchanged with a refrigerant through the spaces between heat-radiation fins in the heat exchanger. After that, the air is blown from the air outlet into the room through a blowing path. The blowing range of the turbo fan in the axial direction depends on the axial height of the outlet. In general, the axial height of the outlet is set to be lower than the height of the heat exchanger. This causes unevenness in wind speed distribution at the portion of the heat exchanger opposed to the outlet and the portion of the heat exchanger separated from the outlet. The unevenness results in unbalanced heat exchange.

As another problem, there is high blowing resistance at the back surface side of the blowing path opposite to the suction guide portion side of the bell-mouth. Accordingly, part of the air leaks from the gap formed between the bell-mouth and the turbo fan into the inside of the turbo fan (recirculation). Therefore, the air not passing through the heat exchanger is retained on the back surface side of the bell-mouth. As the turbo fan rotates, the retained air swirls along the back surface of the bell-mouth opposite to the air suction surface on the air inlet side. That is, swirling airflows are generated. The generation of the swirling airflows leads to reduction in the amount of wind flowing into the heat exchanger. This results in an unsmooth flow of air with lower heat-exchange efficiency.

According to the technique described in JP-A-2007-100548, radial ribs are provided on the back surface of the shroud to suppress loss of air blow. Accordingly, the air approaching the gap formed between the bell-mouth and the shroud is forcibly pushed back to the outside in radial direction.

However, the method described in JP-A-2007-100548 does not solve the swirling airflow problem and thus is less effective in preventing reduction in heat-exchange efficiency. In addition, providing the ribs may increase wind noise and vibration.

SUMMARY

A ceiling-embedded air conditioner includes: a ceiling-embedded casing body that has an air suction path at the center of a lower surface and has an air blowoff path around the air suction path; a turbo fan that is disposed inside the casing body; a heat exchanger that is disposed inside the casing body on an outer peripheral side of the turbo fan; a bell-mouth that guides air sucked from the air suction path toward the inside of the turbo fan; and a rectifier that is provided on a back surface side of the bell-mouth at the air suction path side opposite to an air suction surface of the bell-mouth, the rectifier suppressing swirling airflows generated by part of air blown from the turbo fan swirling along the back surface of the bell-mouth in the same direction as a rotation direction of the turbo fan.

DESCRIPTION OF THE EMBODIMENTS

Figure 1:
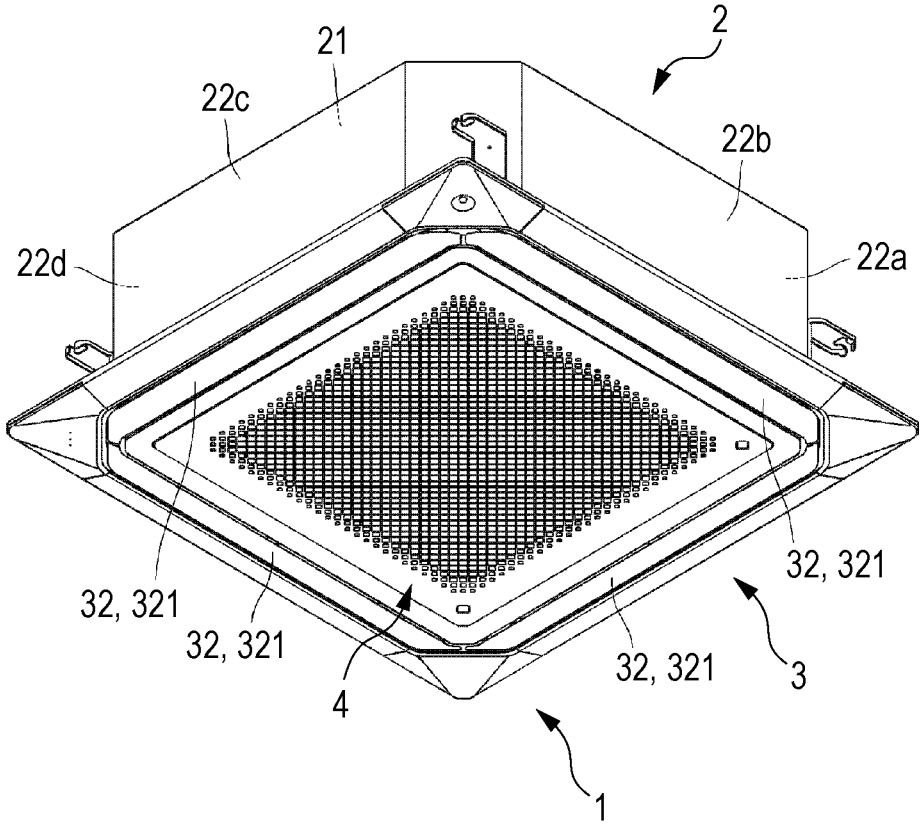
FIG. 1 is a perspective view of a casing body of a ceiling-embedded air conditioner according to one embodiment of the present disclosure as seen from the lower side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An object of the present disclosure is to provide a ceiling-embedded air conditioner as described below. That is, the ceiling-embedded air conditioner prevents the retention of the air and realizes higher heat-exchange efficiency by suppressing occurrence of swirling airflows in the space between the turbo fan and the heat exchanger.

A ceiling-embedded air conditioner (the air conditioner) according to one embodiment of the present disclosure includes: a ceiling-embedded casing body that has an air suction path at the center of a lower surface and has an air blowoff path around the air suction path; a turbo fan that is disposed inside the casing body; a heat exchanger that is disposed inside the casing body on an outer peripheral side of the turbo fan; a bell-mouth that guides air sucked from the air suction path toward the inside of the turbo fan; and a rectifier that is provided on a back surface side of the bell-mouth at the air suction path side opposite to an air suction surface of the bell-mouth, the rectifier suppressing swirling airflows generated by part of air blown from the turbo fan swirling along the back surface of the bell-mouth in the same direction as a rotation direction of the turbo fan.

As a preferable embodiment, the rectifier is erected on the back surface of the bell-mouth.

As a more preferable embodiment, the rectifier has a first rectifying side vertically erected on the back surface of the bell-mouth as a base end and a second rectifying side horizontally extended from the leading end of the first rectifying side. The first rectifying side is formed in parallel to a ventilation surface of the heat exchanger.

Further, the rectifier is preferably formed integrally with the bell-mouth and is also provided as a reinforcement plate for reinforcing strength of the bell-mouth.

As another preferable embodiment, the air conditioner further includes a drain pan that is provided inside the casing body to receive dew condensation water generated by the heat exchanger. The rectifier is erected on the drain pan.

In addition, the heat exchanger preferably has first to fourth heat exchange portions. The rectifier is preferably disposed to be opposed to the first to fourth heat exchange portions with predetermined spacing therebetween and is positioned such that a distance between the ventilation surface of each of the heat exchange portions and an end surface of the rectifier opposed to the ventilation surface is the shortest.

According to the air conditioner, the rectifiers are provided on the back surface of the bell-mouth. By contacting swirling airflows on the rectifiers, the swirling airflows can be forcibly pushed out toward the heat exchanger on the outside of the bell-mouth. This suppresses the occurrence of swirling airflows in the space between the turbo fan and the heat exchanger and prevents the retention of the air. That is, pushing out the swirling airflows toward the heat exchanger increases the heat-exchange efficiency.

Next, an embodiment of the present disclosure will be described with reference to the accompanying drawings. However, the present disclosure is not limited to this.

Figure 2:
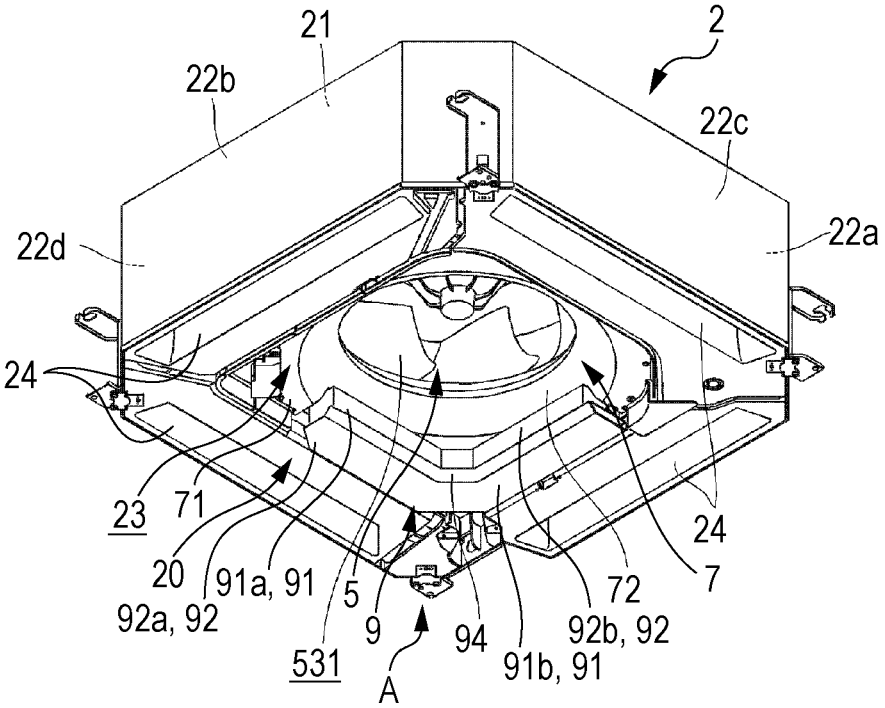
FIG. 2 is a perspective view of the casing body illustrated in FIG. 1 from which a decorative panel is removed.
Figure 3:
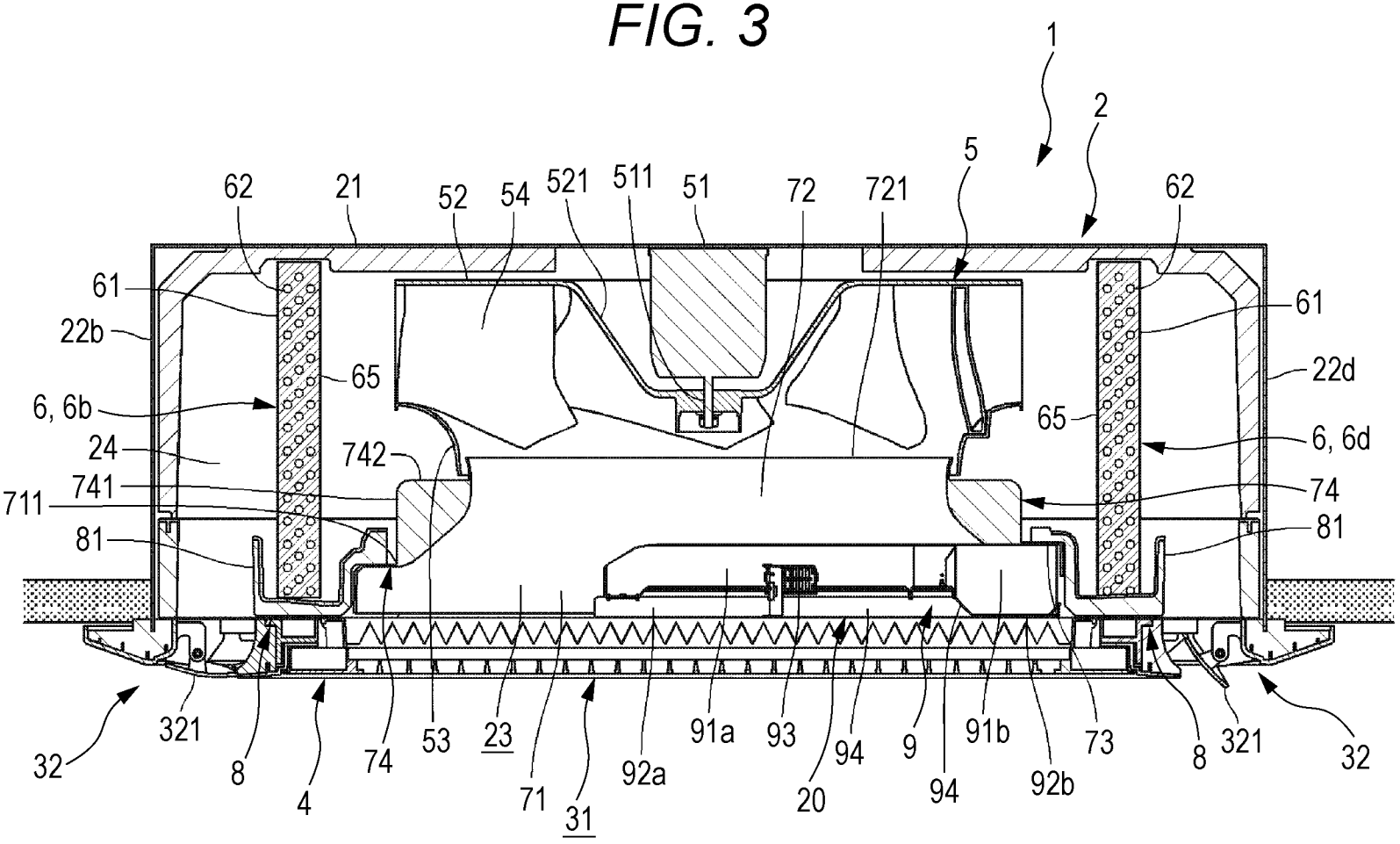
FIG. 3 is a cross-sectional view of inner structure of the casing body.
Figure 4A:
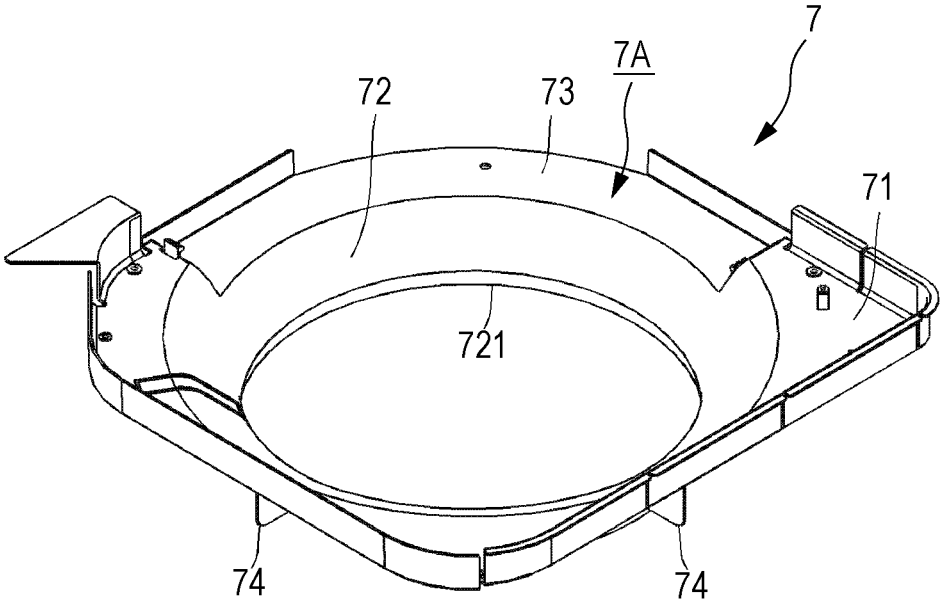
FIG. 4A is a perspective view of a bell-mouth as seen from the front side.
Figure 4B:
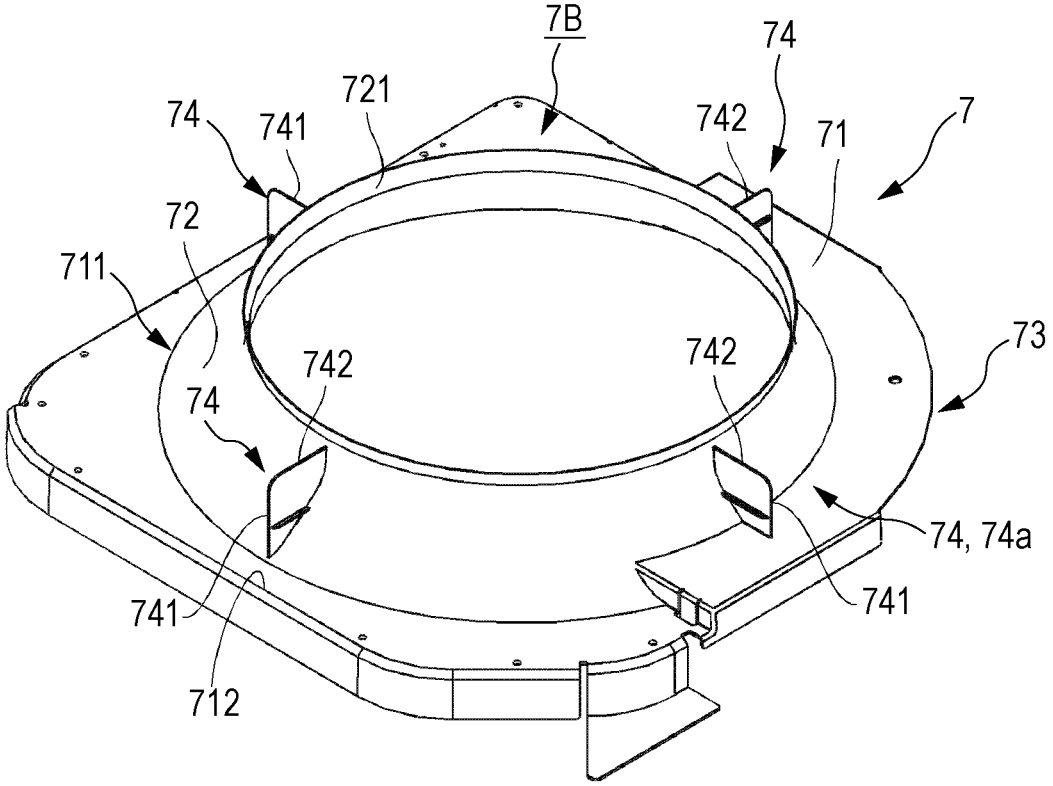
FIG. 4B is a perspective view of the bell-mouth as seen from the rear side.
Figure 5A:
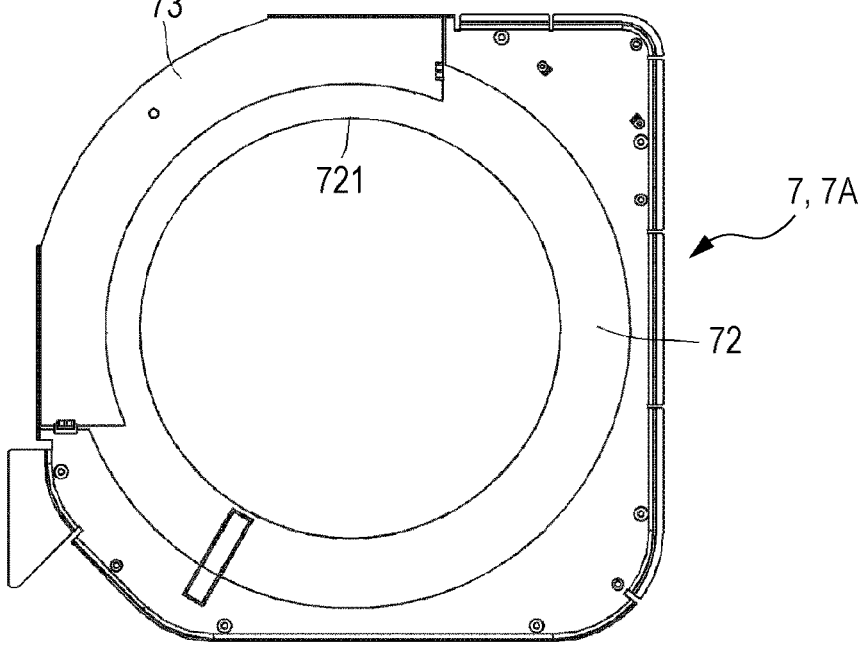
FIG. 5A is a front view of the bell-mouth and FIG. 5B is a rear view of the bell-mouth.
Figure 5B:
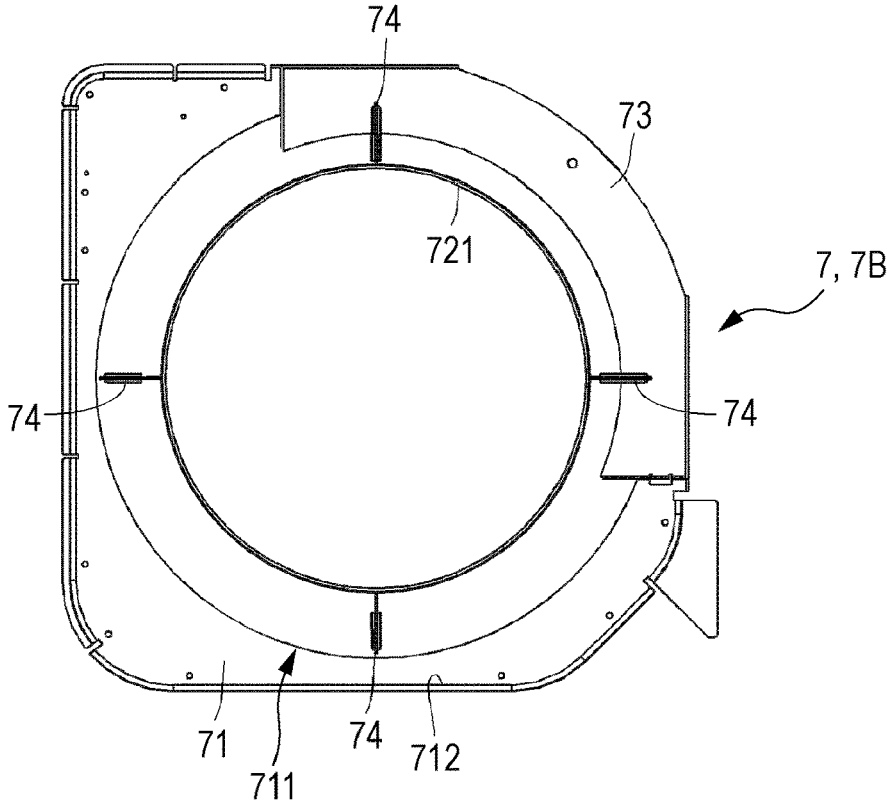

As illustrated in FIGS. 1 to 3, a ceiling-embedded air conditioner 1 includes a cuboid-shaped casing body 2. The cuboid-shaped casing body 2 is stored in the space formed between a ceiling slab and a ceiling panel. The casing body 2 is a box-shaped container having a top plate 21, four side plates 22*a* to 22*d* (hereinafter, referred to as first to fourth side plates 22*a* to 22*d*), and a bottom surface 20. The top plate 21 has a regular square shape with chamfered corners. The first to fourth side plates 22*a* to 22*d* are extended downward from the respective sides of the top plate 21. The bottom surface 20 (lower surface in FIG. 1) is opened. In this embodiment, the corners of the casing body 2 are chamfered according to the shape of the top plate 21.

The bottom surface 20 of the casing body 2 is opened to the inside of the room. An air suction path 23 that is square in cross section is formed at the center of the bottom surface 20. An air blowoff path 24 is formed on the bottom surface 20 of the casing body 2 to surround the four sides of the air suction path 23.

A decorative panel 3 is screwed to the bottom surface 20 of the casing body 2. The decorative panel 3 is made of a synthetic resin and has a flat regular square shape. A square air inlet 31 is provided at the center of the decorative panel 3. The air inlet 31 communicates with the air suction path 23 of the casing body 2. Rectangular air outlets 32 are disposed around the air inlet 31 at four places along the respective sides of the air inlet 31. The air outlets 32 communicate with the air blowoff path 24 at the back surface side (ceiling surface side).

A suction grill 4 is provided to cover the air inlet 31. The suction grill 4 is a synthetic resin molded component. The suction grill 4 is formed in a flat regular square shape to cover the bottom surface 20 of the casing body 2.

In this embodiment, the air outlets 32 are respectively covered with electrically opening and closing wind direction plates 321. During air-conditioning operation, the wind direction plates 321 are opened by a rotation member not illustrated provided on the back surface side of the decorative panel 3 to make the air outlets 32 appear.

The casing body 2 stores a turbo fan 5 as a blowing fan and a heat exchanger 6 therein. A bell-mouth 7 is disposed in the air suction path 23 ranging from the air inlet 31 to the turbo fan 5. The bell-mouth 7 guides the air taken in from the air inlet 31 to the turbo fan 5.

As illustrated in FIGS. 2 and 3, the turbo fan 5 includes a main plate 52, a shroud 53, and a plurality of blades 54. The main plate 52 has a hub 521. A rotation shaft 511 of a drive motor 51 is fixed to the center of the hub 521. The shroud 53 is disposed to be opposed to the main plate 52 along the direction of axis of the rotation shaft 511. The plurality of blades 54 is disposed between the main plate 52 and the shroud 53. An opening 531 is provided at the center of the shroud 53 for inserting a part of the bell-mouth 7 into the turbo fan 5.

The turbo fan 5 is disposed at almost the center of inside of the casing body 2. The turbo fan 5 is hung and held by the drive motor (fan motor) 51 mounted on the top plate 21. Accordingly, as the turbo fan 5 is driven to rotate, the bell-mouth 7 is under negative pressure at the air inlet 31 side (lower side in FIG. 3). Therefore, the air taken in from the air inlet 31 is sucked into the turbo fan 5 through the bell-mouth 7, and is blown toward the outer peripheral direction through the blades 54.

Figure 6:
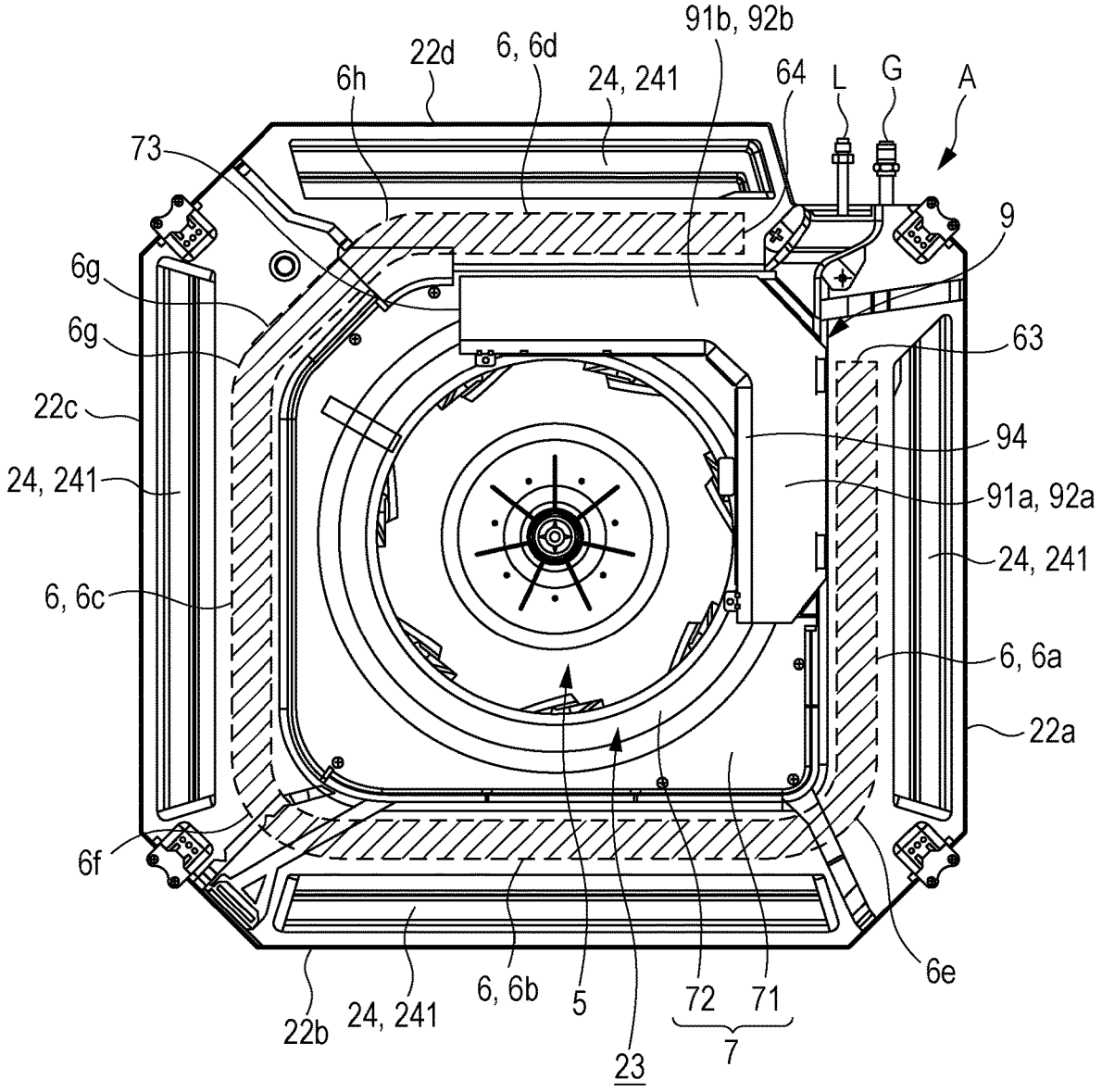
FIG. 6 is a bottom view illustrating the positional relation between a heat exchanger and an electrical equipment box.

As illustrated in FIGS. 3 and 6, the heat exchanger 6 is vertically extended from the top plate 21 to the opening in a bottom surface 20. The heat exchanger 6 is formed in a square frame shape to surround the outer periphery of the turbo fan 5. The heat exchanger 6 has a first heat exchange portion 6*a*, a second heat exchange portion 6*b*, a third heat exchange portion 6*c*, and a fourth heat exchange portion 6*d*. The first heat exchange portion 6*a* is disposed in parallel to the first side plate 22*a*. The second heat exchange portion 6*b* is disposed in parallel to the second side plate 22*b*. The third heat exchange portion 6*c* is disposed in parallel to the third side plate 22*c*. The fourth heat exchange portion 6*d* is disposed in parallel to the fourth side plate 22*d*.

In this embodiment, the heat exchanger 6 includes an elongated square plate-like body with four bent portions. The heat exchanger 6 has a heat-radiation fin group 61 including a large number of strip-shaped heat-radiation fins. The large number of heat-radiation fins is disposed at predetermined spacing therebetween. In the heat exchanger 6, a large number of heat-transfer tubes 62 are inserted into the heat-radiation fin group 61 in parallel to one another.

As illustrated in FIG. 6, the heat exchanger 6 has four bent portions 6*e* to 6*h*. Of these bent portions, the first bent portion 6*e* is formed between the first heat exchange portion 6*a* and the second heat exchange portion 6*b*. The second bent portion 6*f* is formed between the second heat exchange portion 6*b* and the third heat exchange portion 6*c*. The first bent portion 6*e* is bent such that the angle formed by the first heat exchange portion 6*a* and the second heat exchange portion 6*b* is a right angle. The second bent portion 6*f* is bent such that the angle formed by the second heat exchange portion 6*b* and the third heat exchange portion 6*c* is a right angle.

The third bent portion 6*g* and the fourth bent portion 6*h* are positioned between the third heat exchange portion 6*c* and the fourth heat exchange portion 6*d*. The third bent portion 6*g* and the fourth bent portion 6*h* are bent such that, when the third bent portion 6*g* and the fourth bent portion 6*h* are combined with each other, the angle formed by the third heat exchange portion 6*c* and the fourth heat exchange portion 6*d* is a right angle to provide an installation space for a drain pump (not illustrated). The fourth bent portion 6*h* may not be provided between the third heat exchange portion 6*c* and the fourth heat exchange portion 6*d*. In this case, the third bent portion 6*g*, which is disposed between the third heat exchange portion 6*c* and the fourth heat exchange portion 6*d*, may be bent such that the angle formed by the third heat exchange portion 6*c* and the fourth heat exchange portion 6*d* is a right angle.

The end portions of the heat-transfer tubes 62 are drawn from both end portions 63 and 64 of the heat exchanger 6. A U-shaped tube (not illustrated) is coupled to the one end portion 63. At the other end portion 64, gas-side tubes are united into one collective tube and coupled to a gas-side pipe G, and liquid-side tubes are united into one collective tube and coupled to a liquid-side pipe L.

In this embodiment, the heat exchanger 6 is formed in a square shape in a plane view of FIG. 6 by bending one heat exchanger. Instead of this, the heat exchanger 6 may be formed by coupling four small-sized heat exchangers at the end portions.

As described above, the heat exchanger 6 is bent at the first to fourth bent portions 6*e* to 6*h*. Accordingly, the heat exchanger 6 is bent in a square shape in a plane view. In addition, the heat exchanger 6 has the end portions 63 and 64 disposed at a predetermined spacing therebetween.

In this embodiment, as illustrated in FIG. 6, the end portions 63 and 64 are disposed at an upper right corner A of the casing body 2. The gas-side pipe G and the liquid-side pipe L are drawn outward from the corner A of the casing body 2.

The heat exchanger 6 is connected to a reversible refrigeration cycle circuit not illustrated that allows cooling operation and heating operation. The heat exchanger 6 serves as an evaporator to cool the air during cooling operation. Meanwhile, the heat exchanger 6 serves as a condenser to heat the air during heating operation.

Drain pans 8 are provided at the lower end side of the heat exchanger 6 to receive dew condensation water generated by the heat exchanger 6. The drain pans 8 are provided inside the casing body 2 and are provided with gutters 81. The gutters 81 store the lower end side of the heat exchanger 6. The dew condensation water dropped from the heat exchanger 6 is received at the gutters 81 and drawn up by a drain pump not illustrated.

The bell-mouth 7 is composed of a synthetic resin molded component. The bell-mouth 7 includes a base portion 71 and a suction guide portion 72 as illustrated in FIGS. 4A, 4B, 5A, and 5B. The bell-mouth 7 is screwed into the drain pans 8. The base portion 71 is disposed at a front surface (air suction surface) 7A side (plane side in FIG. 4A), and is formed in a square shape corresponding to the shape of the air inlet 31. The suction guide portion 72 is formed in a trumpet shape from the center of the base portion 71 toward the inside of the turbo fan 5.

The base portion 71 is a concave formed in a square shape corresponding to the shape of the air inlet 31. A storage concave portion 73, in which the electrical equipment box 9 described later is to be disposed, is formed in a part of the base portion 71. The storage concave portion 73 has a corner positioned above the corner A of the casing body 2 (refer to FIG. 2). The storage concave portion 73 is extended from the corner as a center in parallel to the first heat exchange portion 6*a* and the fourth heat exchange portion 6*d*. The electrical equipment box 9 is stored in the storage concave portion 73.

The suction guide portion 72 is formed in a trumpet shape (funnel shape) to be gradually smaller in outer diameter with increasing proximity to the center of the rotation shaft 511 of the turbo fan 5. The suction guide portion 72 has a round edge 721 at the upper end side. The edge 721 is inserted into the opening 531 of the turbo fan 5.

The back surface 7B of the bell-mouth 7 (plane side in FIG. 4B) is shaped according to the shapes of the base portion 71, the suction guide portion 72, and the storage concave portion 73. The back surface 7B is opposite to the front surface (air suction surface) 7A of the bell-mouth 7 at the air suction path 23 side. Rectifiers 74 are provided on the back surface 7B of the bell-mouth 7. The rectifiers 74 suppress swirling airflows generated by part of the air blown from the turbo fan 5 swirling along the back surface 7B of the bell-mouth 7 in the same direction as the rotation direction of the turbo fan 5.

The rectifiers 74 are formed in a plate shape. Each of the rectifiers 74 has a first rectifying side 741 and a second rectifying side 742. The first rectifying side 741 is vertically extended from the back surface of the bell-mouth 7 (base portion 71) in the vicinity of a boundary portion 711 between the base portion 71 and the suction guide portion 72. That is, the rectifier 74 is erected on the back surface 7B of the bell-mouth 7. The second rectifying side 742 is horizontally extended from the upper end of the first rectifying side 741 to the edge 721 of the suction guide portion 72. In this example, the rectifiers 74 are provided at four positions by 90 degrees.

The first rectifying side 741 of the rectifier 74 is a side vertical to the base portion 71 as described above. As illustrated in FIG. 3, the first rectifying side 741 is disposed in parallel to a ventilation surface 65 of the heat exchanger 6 opposed to the first rectifying side 741. The rectifier 74 is positioned such that the distance between the first rectifying side 741 and the ventilation surface 65 of each of the heat exchange portions 6*a* to 6*d* is the shortest (the first rectifying side 741 and the ventilation surface 65 of each of the heat exchange portions 6*a* to 6*d* are closest to each other). In this embodiment, the rectifier 74 is positioned such that the distance between the circular-shaped boundary portion 711 and the outer periphery 712 of the square base portion 71 is the shortest.

Of the rectifiers 74, a rectifier 74*a* disposed on the back surface side of the storage concave portion 73 is formed on the storage concave portion 73. Accordingly, the base portion of the rectifier 74*a* (portion in contact with the storage concave portion 73) is shifted toward the round edge 721 according to the shape of the storage concave portion 73. Therefore, the first rectifying side 741 of the rectifier 74*a* is shorter than the first rectifying sides 741 of the other rectifiers 74. Meanwhile, the second rectifying sides 742 of the rectifiers 74 are flush with one another.

Figure 8:
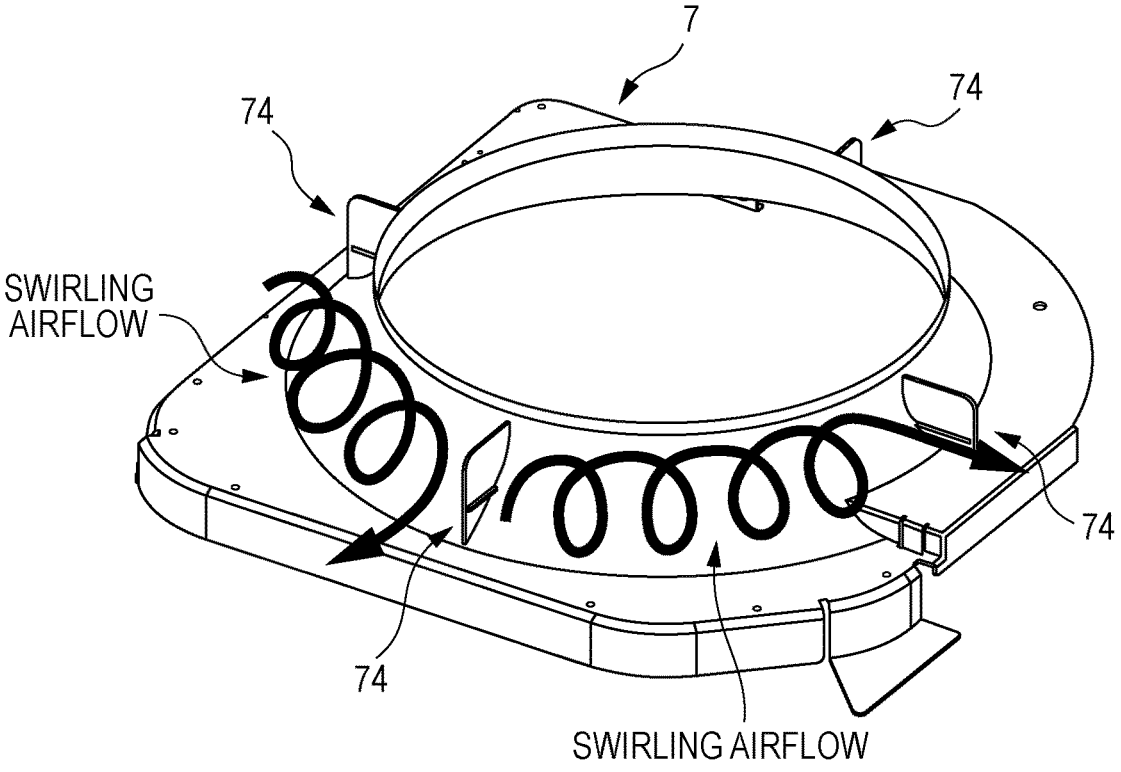
FIG. 8 is an illustrative diagram for describing the rectifying effect of the rectifiers provided on the back surface of the bell-mouth.

According to this, as illustrated in FIG. 8, the rectifiers 74 stem swirling airflows along the back surface of the bell-mouth 7 and push forcibly the air out to the outside of the bell-mouth 7. Accordingly, it is possible to suppress swirling airflows generating in the space between the turbo fan 5 and the heat exchanger 6, prevent the retention of the air, and push the swirling airflows out toward the heat exchanger side. This enhances the efficiency of heat exchange.

The rectifiers 74 are formed integrally with the bell-mouth 7 to serve also as reinforcement plates for reinforcing the strength of the bell-mouth 7. That is, the rectifiers 74 improve the strength of the bell-mouth 7. This suppresses thermal deformation of the bell-mouth 7 at the time of molding, and increases the dimensional accuracy of the bell-mouth 7. Therefore, the gap between the bell-mouth 7 and 53 can be further narrowed. As a result, the recirculation of the air from the gap to the turbo fan 5 is decreased to further enhance the efficiency of heat exchange.

In this embodiment, the rectifiers 74 are formed integrally with the back surface of the bell-mouth 7. Note that the rectifiers 74 may be merely disposed in the ceiling-embedded air conditioner 1 to block swirling airflows along the back surface of the bell-mouth 7. Accordingly, the positions of the rectifiers 74 may not be limited to the bell-mouth 7.

Figure 7:
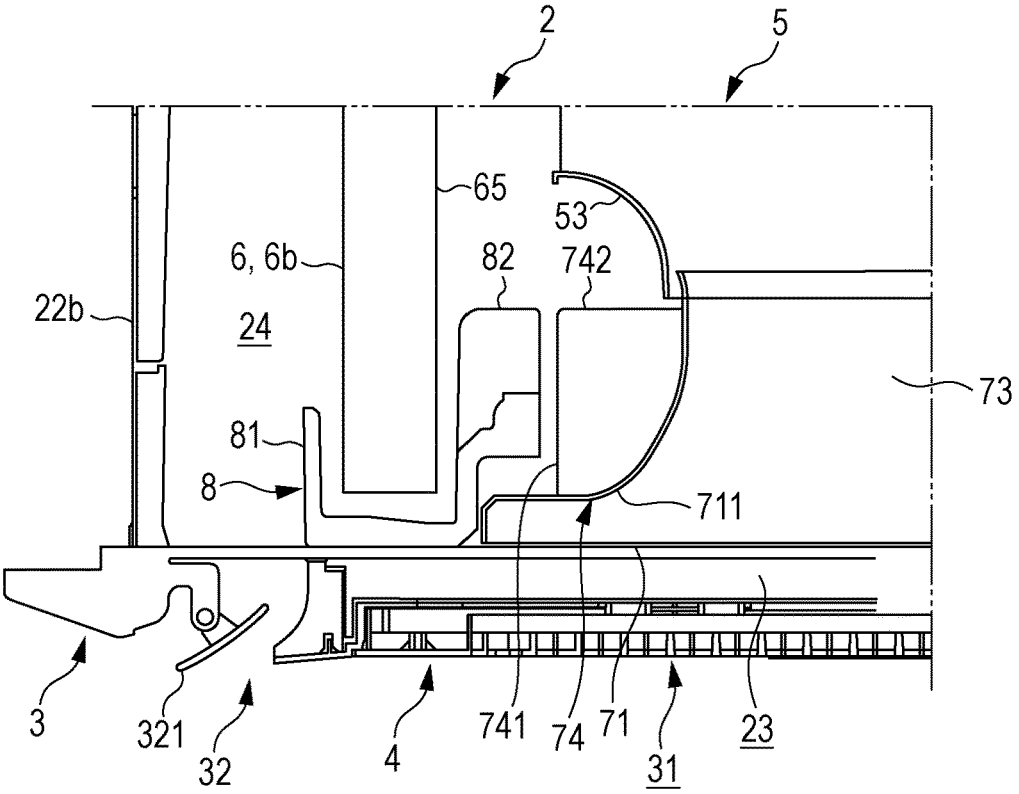
FIG. 7 is a cross-sectional view illustrating the mode in which a rectifier is provided on a drain pan side.

Specifically, as illustrated in FIG. 7, second rectifiers 82 are erected on the drain pans 8. The second rectifiers 82 shut off swirling airflows in cooperation with the rectifiers 74 (hereinafter, referred to as first rectifiers 74). The second rectifiers 82 are plate bodies screwed to the upper ends of the gutters 81 at the turbo fan 5 side to be opposed to the respective first rectifiers 74. The second rectifiers 82 are disposed in parallel to the first rectifiers 74.

The second rectifiers 82 are aligned in height to the second rectifying sides 742 of the first rectifiers 74. The second rectifiers 82 are disposed in abutment with the first rectifying sides 741 of the first rectifiers 74. Accordingly, each of the first rectifiers 74 and each of the second rectifiers 82 serve as one large rectifier. Swirling airflows contacting the first rectifiers 74 move to the vicinity of the heat exchanger 6 from the first rectifiers 74 through the second rectifiers 82. This further enhances the efficiency of heat exchange.

In the embodiment illustrated in FIG. 7, the corresponding first rectifiers 74 and second rectifiers 82 are combined to form one large rectifier. Alternatively, either the first rectifiers 74 or the second rectifiers 82 may be disposed in the ceiling-embedded air conditioner 1. In this case, the disposed first rectifiers 74 or second rectifiers 82 are preferably formed in a large size. The respective second rectifiers 82 may be disposed to be opposed to the first to fourth heat exchange portions 6*a* to 6*d* at predetermined spacing, such that the distances between the ventilation surfaces 65 of the heat exchange portions 6*a* to 6*d* and the end surfaces of the rectifiers 82 opposed to the ventilation surfaces 65 are the shortest.

As illustrated in FIGS. 2 and 6, the electrical equipment box 9 includes a box body 91 and a lid portion 92. The box body 91 has an opened upper surface and stores a substrate and/or electrical equipment (both not illustrated). The lid portion 92 closes the opened surface of the box body 91. In this embodiment, the electrical equipment box 9 is formed by bending a metal plate, for example.

The box body 91 has a first storage portion 91*a* and a second storage portion 91*b*. The box body 91 is formed in an L shape such that the first storage portion 91*a* and the second storage portion 91*b* are orthogonal to each other. A temperature-humidity sensor 93 is erected on the side wall of the first storage portion 91*a* opposed to the suction guide portion 72.

The lid portion 92 is formed in an L shape adapted to the opening of the box body 91. The lid portion 92 includes a first lid portion 92*a* covering the first storage portion 91*a* and a second lid portion 92*b* covering the second storage portion 91*b*. The lid portion 92 is horizontally formed along the open surface of the box body 91. A tapered surface 94 is formed at a corner of the lid portion 92 opposed to the suction guide portion 72. The height of the tapered surface 94 is gradually lower from the upstream to downstream sides of the blowing direction.

Accordingly, the air flowing along the surface of the electrical equipment box 9 can be smoothly guided to the bell-mouth 7 through the tapered surface 94. This reduces ventilation resistance and suppresses decrease in heat exchange efficiency.

As described above, according to the embodiment of the present disclosure, the rectifiers are provided on the back surface of the bell-mouth. By contacting swirling airflows on the rectifiers, it is possible to suppress swirling airflows generated in the space between the turbo fan 5 and the heat exchanger 6 and prevent the retention of the air. That is, the efficiency of heat exchange can be enhanced by pushing swirling airflows out toward the heat exchanger.

The expressions herein indicating shapes or states such as regular square, rectangular, square, circular, vertical, parallel, right angle, 90 degrees, the same, orthogonal, and horizontal, signify not only strict shapes or states but also approximate shapes or states shifted from the strict shapes or states, without deviating from the scope in which the operations and effects of these shapes or states can be achieved.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A ceiling-embedded air conditioner comprising:

a ceiling-embedded casing body that has an air suction path at a center of a lower surface and has an air blowoff path around the air suction path;

a turbo fan that is disposed inside the casing body;

a heat exchanger that is disposed inside the casing body on an outer peripheral side of the turbo fan;

a bell-mouth that guides air sucked from the air suction path toward an inside of the turbo fan; and a rectifier that is provided to erect on a back surface side of the bell-mouth at an air suction path side opposite to an air suction surface of the bell-mouth, the rectifier directing swirling airflows generated by part of air blown from the turbo fan swirling along the back surface of the bell-mouth to the heat exchanger, wherein the rectifier has a first rectifying side vertically and linearly erected on the back surface of the bell-mouth as a base end and a second rectifying side horizontally and linearly extended from a leading end of the first rectifying side, and the first rectifying side is formed in parallel to a ventilation surface of the heat exchanger.

2. The ceiling-embedded air conditioner according to claim 1, wherein the rectifier is formed integrally with the bell-mouth and is also provided as a reinforcement plate for reinforcing strength of the bell-mouth.

3. The ceiling-embedded air conditioner according to claim 1, further comprising a drain pan that is provided inside the casing body to receive dew condensation water generated by the heat exchanger, wherein the rectifier is erected on the drain pan.

4. The ceiling-embedded air conditioner according to claim 1, wherein the heat exchanger has first to fourth heat exchange portions, the bell-mouth includes a base portion with a square shape, and a suction guide portion with a trumpet shape disposed in the base portion and extending upwardly from the base portion, a distance from an outer side of the base portion to the suction guide portion, in a straight radial line passing through the center of the circumference delimited by the trumpet portion of the suction guide portion changes, and the rectifier is positioned such that, in the rectifier location in the bell-mouth, a distance between the outer side of the base portion and a boundary portion of the suction guide portion is shortest.

5. The ceiling-embedded air conditioner according to claim 1, wherein the first rectifying side is located at a position where a distance between one outer side of a base portion in a rectangular shape of the bell-mouth and a boundary portion of the base portion with respect to a suction guide portion having a cylindrical shape and erecting from the base portion is shortest.

6. The ceiling-embedded air conditioner according to claim 1, wherein the rectifier includes only four members 90 degrees spaced apart each other around the bell-mouth.

7. The ceiling-embedded air conditioner according to claim 1, wherein the turbo fan includes a shroud disposed over the bell mouth, and the second rectifying side of the rectifier extends from behind the bell mouth to a position under an outer edge of the shroud.

* * * * *